US011806859B2

(12) United States Patent
Byars

(10) Patent No.: US 11,806,859 B2
(45) Date of Patent: Nov. 7, 2023

(54) HEATING MECHANISM FOR TOOLS

(71) Applicant: Jeptha Byars, Tulsa, OK (US)

(72) Inventor: Jeptha Byars, Tulsa, OK (US)

( * ) Notice: Subject to any disclaimer, the term of this patent is extended or adjusted under 35 U.S.C. 154(b) by 247 days.

(21) Appl. No.: 17/469,247

(22) Filed: Sep. 8, 2021

(65) Prior Publication Data

US 2023/0075518 A1 Mar. 9, 2023

(51) Int. Cl.
*B25H 3/04* (2006.01)
*H05B 3/06* (2006.01)

(52) U.S. Cl.
CPC ..... *B25H 3/04* (2013.01); *H05B 3/06* (2013.01); *H05B 2203/03* (2013.01)

(58) Field of Classification Search
CPC ..... A47F 7/00; A47F 7/0021; A47F 7/0028; A47F 7/0035; B25H 3/00; B25H 3/003; B25H 3/04; B25H 3/06; B65D 81/3476; H05B 3/00; H05B 3/06; H05B 3/08; H05B 2203/03
USPC ..... 206/349, 376, 377, 378; 211/70.6; 219/209, 210
See application file for complete search history.

(56) References Cited

U.S. PATENT DOCUMENTS 2,932,718 A * 4/1960 Marsters ..... B01L 7/00 219/521
4,812,616 A * 3/1989 Hong ..... A45D 2/18 219/521
4,911,297 A * 3/1990 Suburu ..... B25H 3/04 206/372
5,036,975 A * 8/1991 Chow ..... B25H 3/04 312/902
5,276,310 A * 1/1994 Schmidt ..... H05B 3/26 219/521
5,346,063 A * 9/1994 Chow ..... B25H 3/04 206/483
5,505,316 A * 4/1996 Lee ..... B25H 3/04 211/175
5,579,929 A * 12/1996 Schwartz ..... B25H 3/04 211/74
5,638,964 A * 6/1997 Ernst ..... B25H 3/04 211/70.6
D392,489 S * 3/1998 Ernst ..... D6/571
6,039,178 A * 3/2000 Ernst ..... B25H 3/06 211/70.6
6,315,121 B1 * 11/2001 Hansen ..... B25H 3/04 206/451

(Continued)

*Primary Examiner* — Joshua E Rodden
(74) *Attorney, Agent, or Firm* — Lyman Moulton, Esq.; Moulton Patents, PLLC

(57) ABSTRACT

Heating Mechanism For Tools is an ingenious and practical invention of a heated tool rack which includes: a first steel plate; a second steel plate, wherein each steel plate includes a cooperating receiving rack for wrenches; a power source attached to each plate; a first charge on the first plate; and a second charge on the second plate. The cooperating racks include a first receiving rack and a second receiving rack, wherein a lineal graduating resistive divider of a cleaving type and a planer type lies between the first steel plate on a first side and the second steel plate on a second side. A resistive heat therein is proportional to the graduation. A hole is provided in each plate for mounting purposes. The tool rack also includes a USB connector, where the USB connector supplies power for application of an electrical charge to each side of the resistive divider.

20 Claims, 7 Drawing Sheets

(56) References Cited

U.S. PATENT DOCUMENTS

| | | | | |
|---|---|---|---|---|
| 7,208,700 | B2 * | 4/2007 | Peterson | F24C 7/105 219/217 |
| 8,067,715 | B2 * | 11/2011 | Peterson | B25H 3/02 219/217 |
| D897,802 | S * | 10/2020 | Byars | D8/71 |
| 2015/0305979 | A1 * | 10/2015 | Tintinger | F25B 21/02 206/524.1 |
| 2019/0061139 | A1 * | 2/2019 | Kao | B65D 25/101 |
| 2020/0053840 | A1 * | 2/2020 | Byars | G06F 1/266 |
| 2023/0075518 | A1 * | 3/2023 | Byars | B25H 3/04 |

* cited by examiner

HEATING MECHANISM FOR TOOLS

BACKGROUND

Small hand tools are used by many workers and former mechanic construction people or other professions. These hand tools may be used to perform work that involves screwing or adjusting bolts, etc. Small hand tools are typically made of metal in the form of steel or aluminum and therefore can be influenced by temperature. Some workers spend significant time working in outdoor areas and in particularly cold environments. As such, metal tools become cold in such environments. Cold metal tools are a little bit more difficult to maneuver, if the individual needs to wear gloves and such use diminishes the dexterity related to use of the tool. As a result, it would be advantageous to have a device that could be used to warm or keep the metal tools warm in a cold environment.

A heating apparatus to help tools not be cold to the touch, helping the user to not have pain or discomfort is desirable. There have been no products available as original equipment or as an aftermarket to address these problems. There exists a need for a device or system or tool to address these problems not being met by any known or disclosed device or system of present.

SUMMARY OF THE INVENTION

The object of the present invention is to provide a heating mechanism, which is specifically designed to store and mount tools in the form of wrenches where heat is transferred to tools and the temperature of the tools are regulated. The Heating Mechanism For Tools is a tool rack which includes: first steel plate; a second steel plate, wherein each steel plate includes a cooperating receiving rack for wrenches; a power source attached to a graduated resistive divider; a first charge on one side and a second charge on another side. The cooperating racks include a first receiving rack and a second receiving rack, wherein the resistive divider lies between the first steel plate on a first side and the second steel plate on a second side in a cleaving manner or in a planer manner. A hole is provided in each plate for mounting purposes. The tool rack also includes a USB connector, where the USB connector supplies power for application of an electrical charge to each side of the tool rack.

Figure 1:
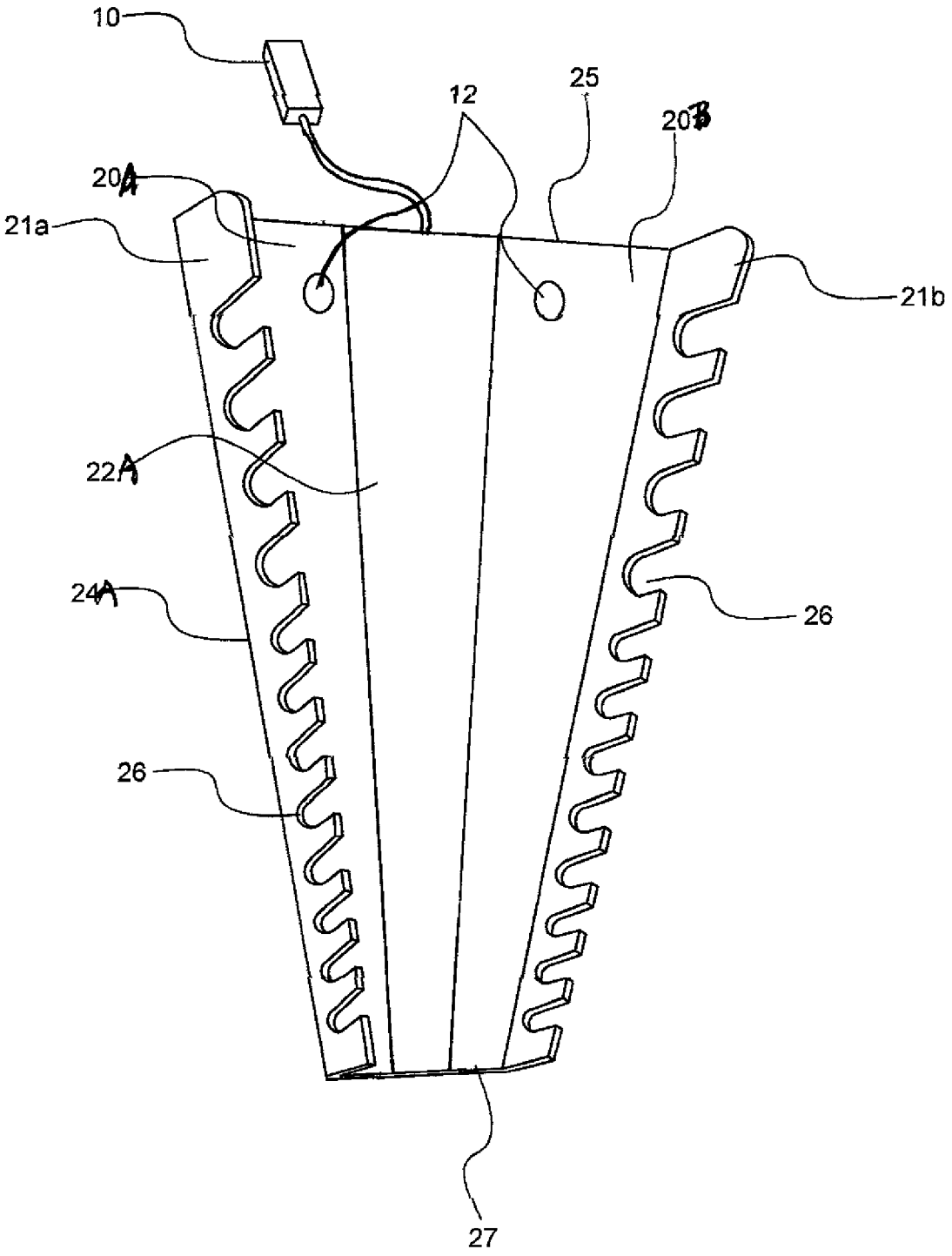
FIG. 1 is a front perspective view of the Heating Mechanism For Tools with a graduated and cleaving resistive divider, in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1 is a front perspective view of a Heating Mechanism For Tools, with a graduated and cleaving resistive divider in accordance with an embodiment of the present disclosure. The perspective includes a first steel plate 20A and a second steel plate referenced as 20B and the associated cooperating receiving racks for wrenches. The first receiving rack referenced as 21A, a second receiving rack referenced as 21B extend at right angles from each respective steel plate as shown on each side of the tool rack. The first steel plate referenced as 20A is on a first side and the second steel plate referenced as 20B is on a second side of a cleaving and graduating electrically resistive divider referenced as 22A.

The electrically resistive divider referenced as 22A separates the steel plates referenced as 20A and 20B and cleaves the first half of rack from the second half of the steel rack. A hole is provided in each plate (for mounting purposes) referenced as 12. USB Connector referenced as 10 supplies power for application of an electrical charge to each side of the tool rack. Tools are received in openings referenced as 26 along each respective rack referenced as 21A and 21B.

The top edge referenced as 25 is the first width of the rack depicted and the second width depicted is at the lower Edge referenced as 27. The width and the openings 26 changes gradually, aka graduate to provide adequate or suitable widths and openings for a wrench set with smaller wrenches placed at the lower end in the smaller openings and larger wrenches are placed at the top end in the larger openings 26, in accordance with an embodiment of the present disclosure. The back plate 24A comprises a coating and is a steel plate and an insulating plate in embodiments of the disclosure. The cleaving and graduated resistive divider also extends there through in embodiments.

The present invention relates to a rack that is mounted on a wall or other flat surface that provides heating sensations for tools placed in the rack. In particular the present invention is designed and adapted for receiving wrenches. The rack includes a series of open slots that receive wrenches along the length of the rack. The rack is mounted on a flat surface and includes a steel plate on each side thereof. A rubber backing is provided and a center electrically resistive divider is also provided on the rack. The rack is heated by applying an electrical charge to plates which comprise the rack. A USB cord provides power for application of a charge to each respective plate. The application of the charge radiates heat along the steel plates of the rack.

Figure 2:
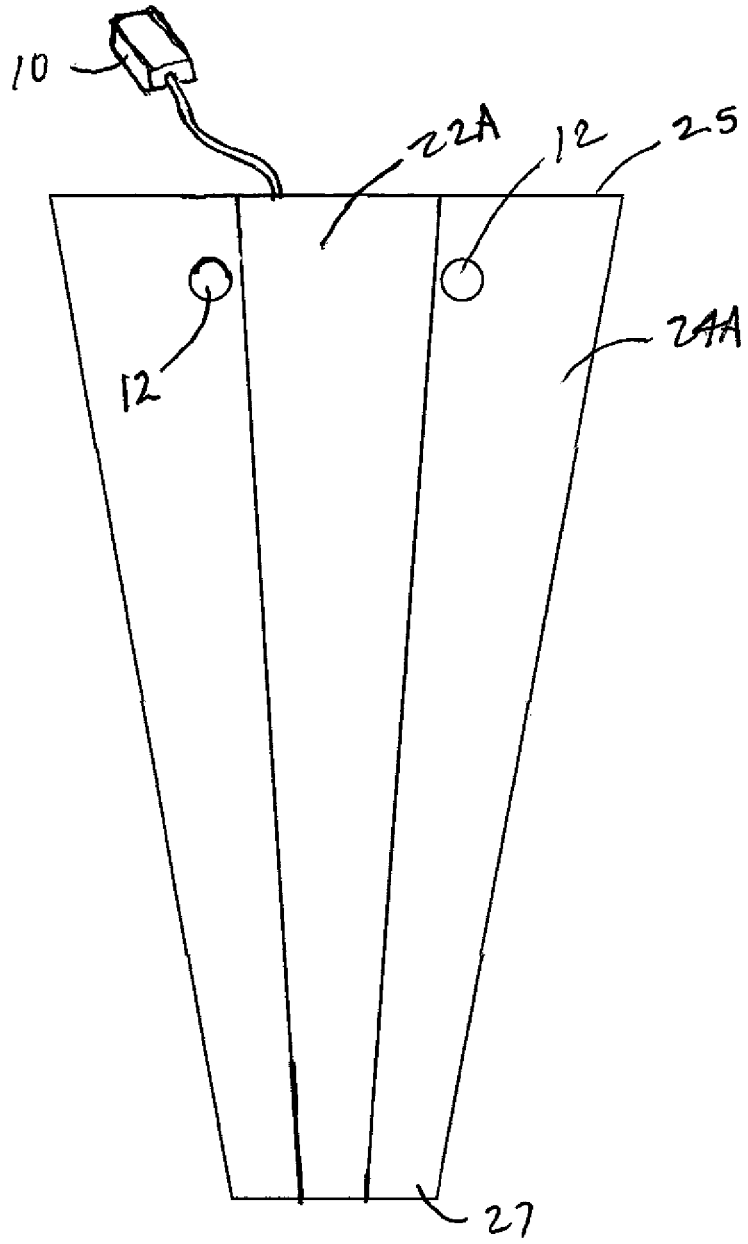
FIG. 2 is a back elevational view of the Heating Mechanism For Tools with a graduated and cleaving resistive divider in accordance with an embodiment of the present disclosure.

FIG. 2 is a back elevational view of the Heating with a graduated and cleaving resistive divider in accordance with an embodiment of the present disclosure. The back side referenced as 24A includes an insulating material backing that provides padding and insulation for each respective steel plates. The charging associated with the steel plates referenced as 20A and 20B include a positive charge applied to the first side 20A and a relatively negative charge relative to the first charge applied to the second side 20B. The mounting holes 12 are seen extending there through. The narrow end 27 graduates progressively larger on a lineal plane toward the wider end 25 as does the cleaving and graduating resistive divider 22A so an orthogonal and lineal resistance from the left mounting hole to the right mounting hole is greater than a similar lineal resistance on the narrow end 27.

Figure 3:
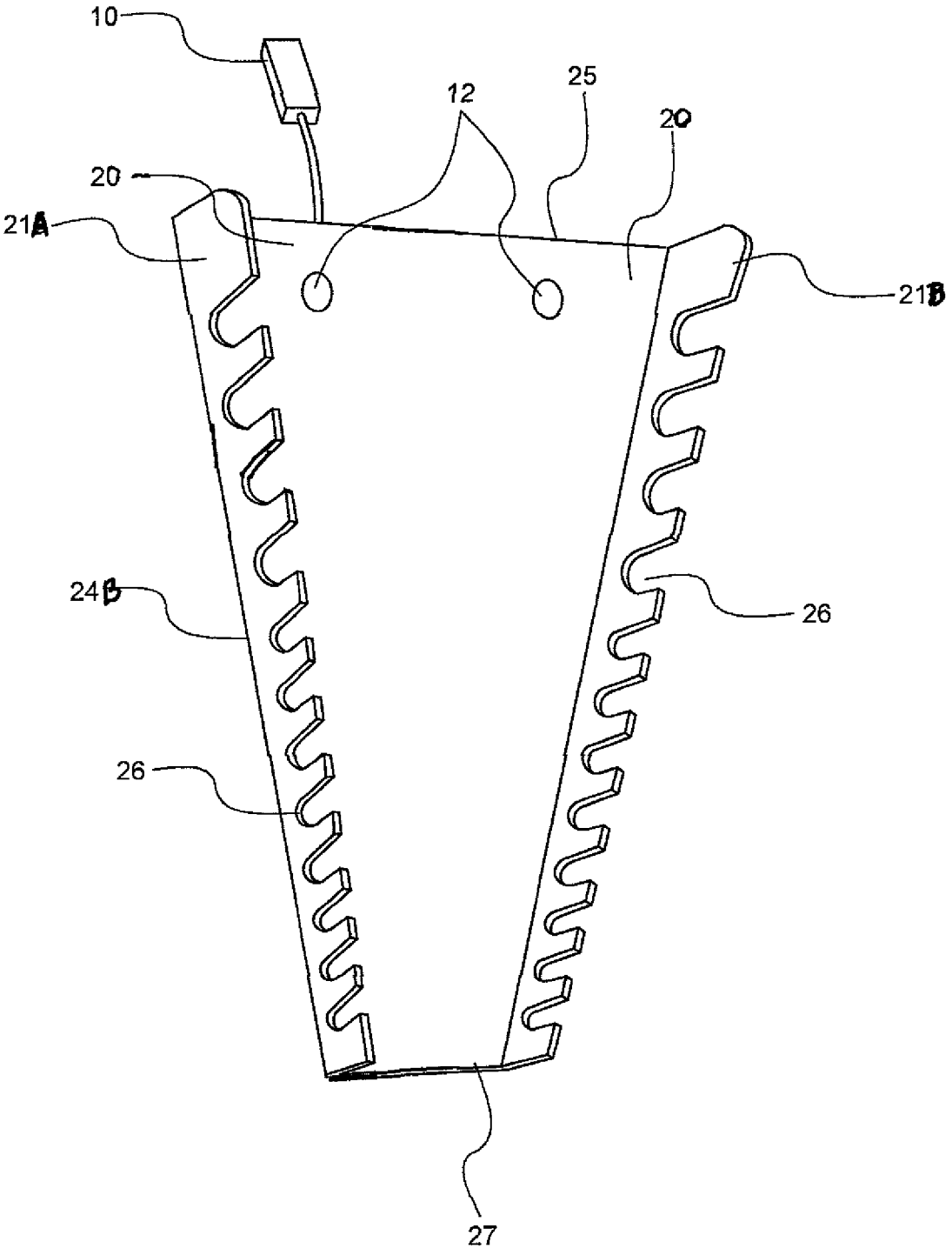
FIG. 3 is a front perspective view of a Heating Mechanism for Tools with a graduated planar resistive divider in accordance with an embodiment of the present disclosure.

FIG. 3 is a front perspective view of a Heating Mechanism for Tools with a graduated planar resistive divider in accordance with an embodiment of the present disclosure. The graduated planar resistive divider (not shown) is sandwiched between the front plate 20 and the back plate 24B. Other reference features are similar or the same with those of FIG. 1.

Figure 4:
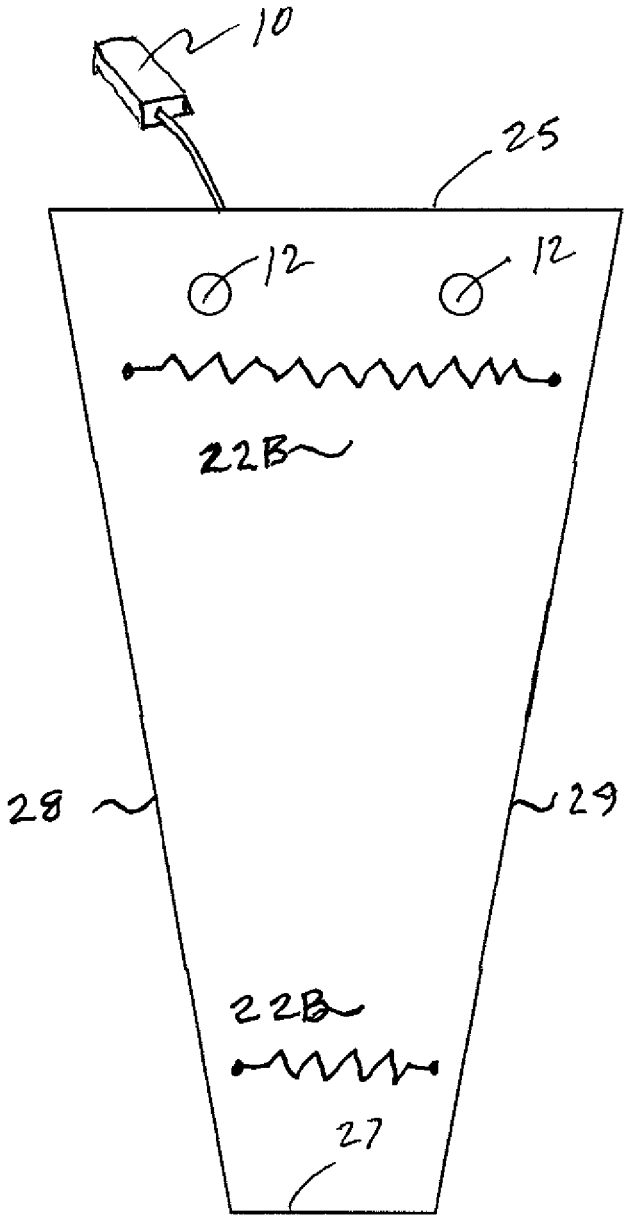
FIG. 4 is a back elevational view of the graduated planar resistive divider in accordance with an embodiment of the present disclosure.

FIG. 4 is a back elevational view of the graduated planar resistive divider in accordance with an embodiment of the present disclosure. The graduated planar resistive divider 22B matches the planar shape of the front plate 20 having a narrow end 27 and a wider end 25 in relation to the narrow end 25. A lineal resistance from a left side 28 of the graduated and planar resistive divider is greater proximal the wider end 25 than a lineal resistance from the left side 28 to the right side 29 proximal the narrow end of the device. This facilitates more proportional heat near the wider end for larger wrenches and less proportional heat near the narrow end for smaller wrenches (not shown). The resistance shown schematically near the wide end 25 is therefore larger than the resistance shown schematically near the narrow end 27 lineally from side to side. A similar larger resistance and smaller resistance occurs in the cleaving and graduated resistive divider 22A shown in FIG. 1 and FIG. 2 lineally from side to side.

Figure 5:
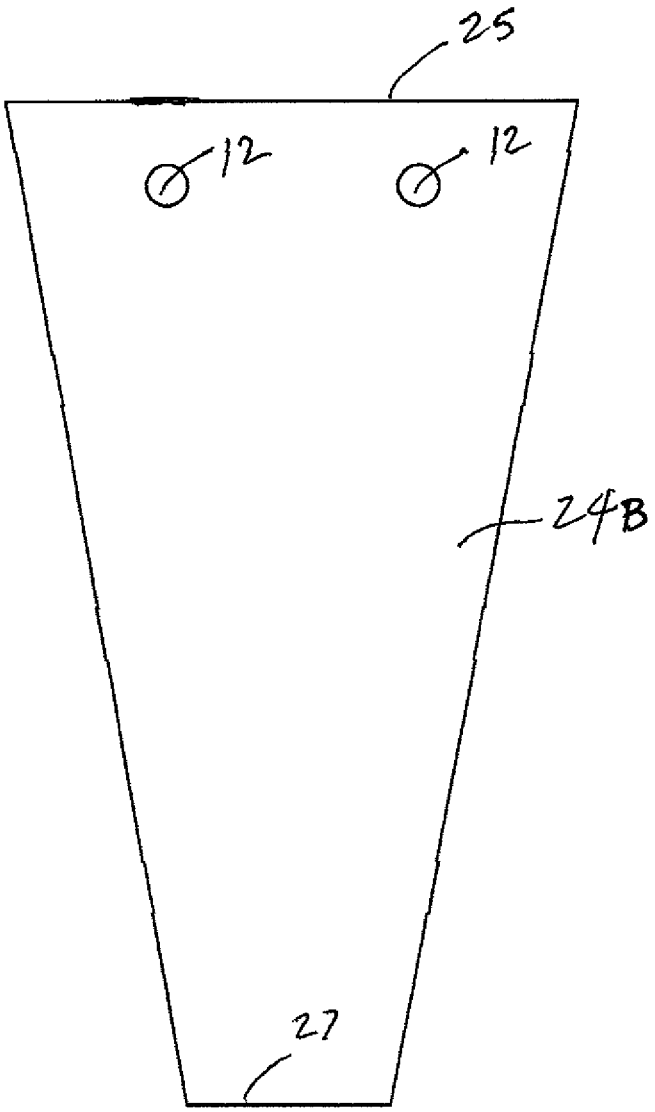
FIG. 5 is a back elevational view of a back plane for the Heating Mechanism for Tools with a graduated planar resistive divider in accordance with an embodiment of the present disclosure.

FIG. 5 is a back elevational view of a back plane for the Heating Mechanism for Tools with a graduated planar resistive divider in accordance with an embodiment of the present disclosure. The graduated and planer back plate 24B matches the lineal geometry of the front plate 20 and the resistive divider 22B sandwiched there between. The back plate 24B adds insulation and strength to the disclosed tool device. Other reference features are similar or the same with those of FIG. 1.

Figure 6:
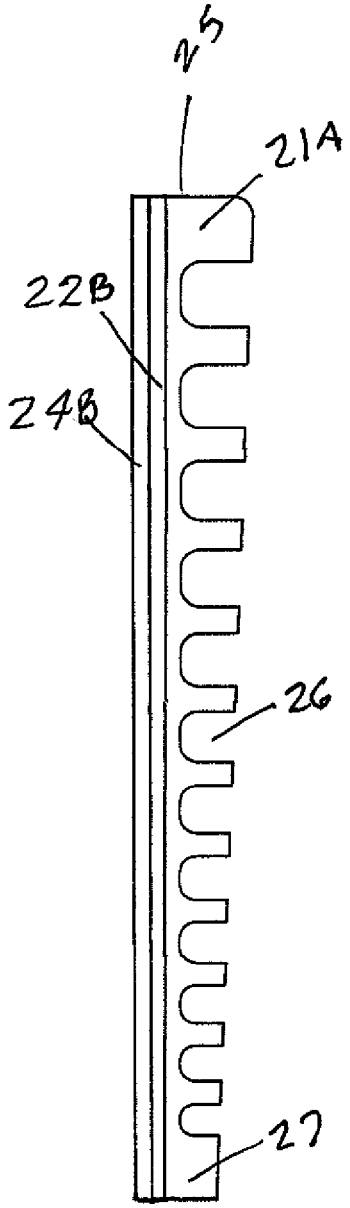
FIG. 6 is a left side elevational view of the Heating Mechanism For Tools showing metal and insulating layers in accordance with an embodiment of the present disclosure.

FIG. 6 is a left side elevational view of the Heating Mechanism For Tools showing metal and insulating layers in accordance with an embodiment of the present disclosure. The view includes the receiving rack 21A, the wide end 25 and the narrow end 27 and the graduated and planar resistive divider 22B sandwiched between the front plate 20 and the back plate 24B. The notches 26 defined in the left receiving rack 21A and the right receiving rack 21B graduate from smaller notches near the narrow end 27 to larger notches near the wider end 25.

Figure 7:
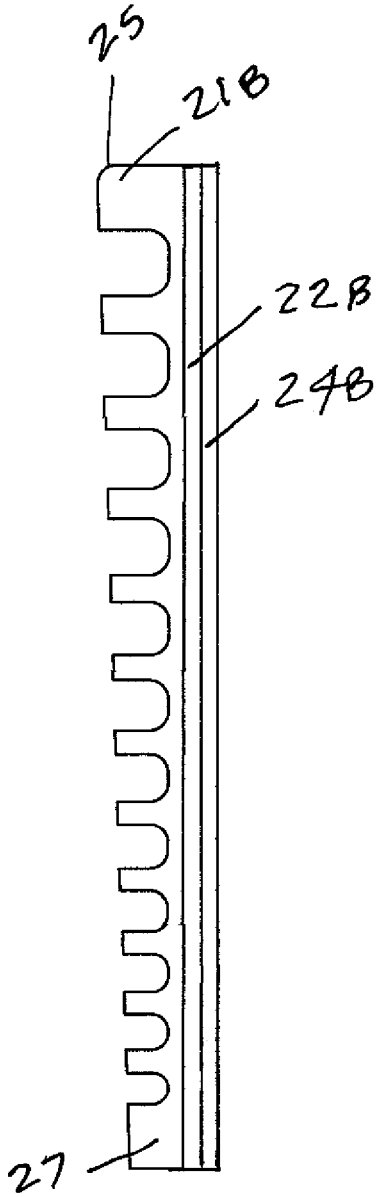
FIG. 7 is a right side elevational view of the Heating Mechanism For Tools showing metal and insulating materials in accordance with an embodiment of the present disclosure.

FIG. 7 is a right side elevational view of the Heating Mechanism For Tools showing metal and insulating materials in accordance with an embodiment of the present disclosure. The view includes the receiving rack 21B, the wide end 25 and the narrow end 27 and the graduated and planar resistive divider 22B sandwiched between the front plate 20 and the back plate 24B. The notches 26 defined in the left receiving rack 21A and the right receiving rack 21B graduate from smaller notches near the narrow end 27 to larger notches near the wider end 25.

Figure 8:
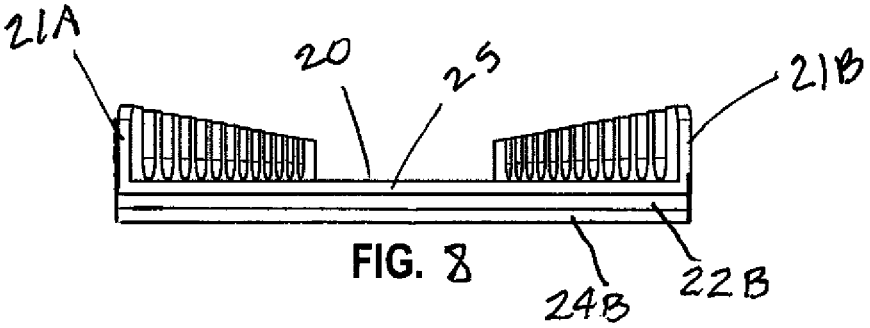
FIG. 8 is a larger end view of the Heating Mechanism For Tools showing metal and insulating materials in accordance with an embodiment of the present disclosure.

FIG. 8 is a larger end view of the Heating Mechanism For Tools showing metal and insulating materials in accordance with an embodiment of the present disclosure. The view includes the wider end 25 and the graduating and planer resistive divider 22B sandwiched between the front plate 20 and the back plate 24B. The left and the right receiving racks 21A and 21B are also depicted respectively.

Figure 9:
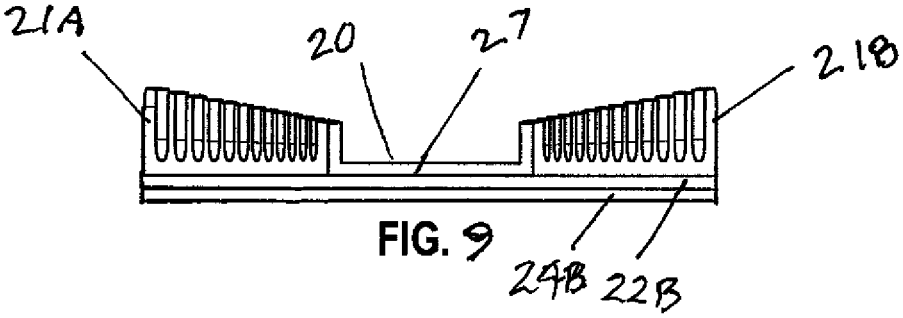
FIG. 9 is a smaller end view of the Heating Mechanism For Tools showing metal and insulating materials in accordance with an embodiment of the present disclosure.

FIG. 9 is a smaller end view of the Heating Mechanism For Tools showing metal and insulating materials in accordance with an embodiment of the present disclosure. The view includes the narrow end 27 and the graduating and planer resistive divider 22B sandwiched between the front plate 20 and the back plate 24B. The left and the right receiving racks 21A and 21B are also depicted respectively.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A tool rack comprising:

a first steel plate and a second steel plate, wherein each steel plate includes a smaller end and progressively extends to a larger end and defines openings for receiving wrenches of smaller and larger sizes respectively; and an electrically resistive divider configured to cleave the first plate and the second plate, and to provide a graduated heat proportional to a lineal electrical resistance there through between the first plate and the second plate, wherein a smaller end of the electrically resistive divider comprises a lower lineal resistance with lower heat and corresponds to the smaller end of each steel plate and progressively graduates to a larger end of the electrically resistive divider comprising a higher lineal resistance with a higher heat.

2. The tool rack according to claim 1, wherein the electrically resistive divider is disposed between the first plate and the second plate in a plane with the first and the second plate.

3. The tool rack according to claim 1, further comprising a back plate comprising an insulating material.

4. The tool rack according to claim 1, wherein the first plate and the second plate are bent at right angles to form receiving racks including a first receiving rack and a second receiving rack respectively.

5. The tool rack according to claim 1, wherein the electrically resistive divider cleaves the first steel plate on a first side and the second steel plate on a second side.

6. The tool rack according to claim 1, further including a hole in each plate for mounting purposes.

7. The tool rack according to claim 1, further comprising a transformer from a household 120 VAC (volts alternating current) to a nominal USB connector voltage to supply first and the second electrical charges.

8. The tool rack according to claim 1, further comprising a transformer from a household 120 VAC (volts alternating current) to a lesser DC (direct current) voltage and a lesser current to supply first and the second electrical charges.

9. The tool rack according to claim 1, wherein the electrically resistive divider is coated in an electrically insulating material which allows a heat transfer therefrom.

10. A tool rack device comprising:

a front steel plate comprising a smaller end and a larger end and planar graduating there between defining openings sized for wrenches of smaller and larger sizes respectively;

a back plate configured to cover a back area equal to the front plate;

an electrically resistive divider sandwiched between the front plate and the back plate, and to provide a heat proportional to a graduated and lineal electrical resistance there through between the front plate and the back plate.

11. The tool rack device of claim 10, wherein the electrically resistive divider is sandwiched between the front plate on one side and the back plate on another side.

12. The tool rack device of claim 10, wherein the electrically resistive divider comprises a lineal geometry having a wide end and a narrow end for more lineal resistance and less lineal resistance respectively.

13. The tool rack device of claim 10, wherein the electrically resistive divider comprises a lineal geometry having a wide end and a narrow end for more heat and less heat respectively.

14. The tool rack device of claim 10, wherein the electrically resistive divider comprises a lineal wide end and a lineal narrow end for more heat for larger wrenches and less heat for smaller wrenches respectively.

15. The tool rack device of claim 10, wherein the first plate and the second plate are bent at right angles to form receiving racks including a first receiving rack and a second receiving rack respectively.

16. The tool rack device of claim 10, wherein the tool rack device is covered with an electrically insulating material which allows a heat transfer there through.

17. The tool rack device of claim 10, wherein the electrically resistive divider is electrically insulated from the front steel plate and the back plate.

18. The tool rack device of claim 10, further comprising a voltage put across the electrically resistive divider from the front steel plate to the back plate.

19. The tool rack device of claim 10, wherein a heat transfer from the tool rack device to a wrench therein occurs through conduction there through.

20. The tool rack device of claim 10, wherein a heat transfer from the tool rack device to a wrench therein occurs through a convection of air by an air movement there around.

* * * * *